US006229142B1

(12) United States Patent
Bateman et al.

(10) Patent No.: US 6,229,142 B1
(45) Date of Patent: May 8, 2001

(54) TIME OF FLIGHT MASS SPECTROMETER AND DETECTOR THEREFOR

(75) Inventors: Robert H. Bateman, Knutsford; Anthony J. Gilbert, Chapel-en-le-Frith; Thomas O. Merren, Altrincham; John B. Hoyes, Stockport; Jonathan C. Cottrell, Altrincham, all of (GB)

(73) Assignee: Micromass Limited, Manchester (GB)

( * ) Notice: Subject to any disclaimer, the term of this patent is extended or adjusted under 35 U.S.C. 154(b) by 0 days.

(21) Appl. No.: 09/381,774

(22) PCT Filed: Jan. 25, 1999

(86) PCT No.: PCT/GB99/00250

§ 371 Date: Dec. 17, 1999

§ 102(e) Date: Dec. 17, 1999

(87) PCT Pub. No.: WO99/38191

PCT Pub. Date: Jul. 29, 1999

(30) Foreign Application Priority Data

| | | |
|---|---|---|
| Jan. 23, 1998 | (GB) | 9801565 |
| Feb. 27, 1998 | (GB) | 9804286 |
| May 20, 1998 | (GB) | 9810867 |
| Jun. 18, 1998 | (GB) | 9813224 |

(51) Int. Cl.[7] ..... H01J 49/40
(52) U.S. Cl. ..... 250/287; 250/287; 250/288
(58) Field of Search ..... 250/288, 287, 250/290, 292, 286

(56) References Cited

U.S. PATENT DOCUMENTS

| | | | | |
|---|---|---|---|---|
| 4,490,806 | | 12/1984 | Enke et al. . | |
| 4,691,160 | | 9/1987 | Ino . | |
| 5,428,357 | | 6/1995 | Haab et al. . | |
| 5,463,219 | | 10/1995 | Buckley et al. . | |
| 5,777,326 | * | 7/1998 | Rockwood et al. | 250/287 |
| 5,986,258 | * | 11/1999 | Park | 250/287 |
| 6,020,586 | * | 2/2000 | Dresch et al. | 250/287 |
| 6,040,575 | * | 3/2000 | Whitehouse et al. | 250/288 |
| 6,118,120 | * | 9/2000 | Fenn et al. | 250/288 |

FOREIGN PATENT DOCUMENTS

| | | |
|---|---|---|
| 2266407 | 10/1993 | (GB) . |
| 2300513 | 11/1996 | (GB) . |
| 851549 | 7/1981 | (SU) . |
| WO 94/28631 | 12/1994 | (WO) . |
| WO 95/00236 | 1/1995 | (WO) . |
| WO 98/21742 | 5/1998 | (WO) . |

OTHER PUBLICATIONS

Stephan, Zehnpfenning and Benninghoven, J. of Vac. Sci. Technol. A 1994, vol. 12 (2), pp. 405–410.
Rockwood et al.,Abstracts, Pittcon 1997, Atlanta, GA, Mar. 1997, Paper No. 733.
Kristo and Enke, Rev. Sci. Instrum. 1988, vol. 59, (3), pp. 438–442.
Cierjacks, Petkovic et al, Nuclear Instrum. And Methods in Physic Research 1985, vol. A238, pp. 354–364.
Kellogg, Rev. Sci. Instrum. Jan. 1987, vol. 58 (1), pp. 38–42.

* cited by examiner

*Primary Examiner*—Teresa M. Arroyo
*Assistant Examiner*—Johnnie L. Smith, II
(74) *Attorney, Agent, or Firm*—Alix, Yale & Ristas, LLP

(57) ABSTRACT

An ion detector (27) for use in a time-of-flight mass spectrometer (1) is disclosed. The ion detector (27), which has an extended dynamic range, comprises collection electrodes (36, 38; 39) of different surface areas. In one embodiment the collection electrodes (36, 38; 39) are formed in an array consisting of a larger plate-like collection electrode (36, 38) and a smaller plate-like collection electrode (39). Micro-channel multiplier plates (31, 32) may be arranged in front of the collection electrodes (36, 38; 39). In an alternative embodiment the collection electrodes consist of a grid (42) or, more preferably, a wire electrode (50) disposed in front of a plate-like electrode (43).

25 Claims, 3 Drawing Sheets

TIME OF FLIGHT MASS SPECTROMETER AND DETECTOR THEREFOR

CROSS-REFERENCE TO RELATED APPLICATIONS

This is the national stage of International Application No. PCT/GB99/00250 filed Jan. 25, 1999.

BACKGROUND OF THE INVENTION

This invention relates to a time-of-flight mass spectrometer and its associated ion detection system. It provides apparatus for detecting ions in a time-of-flight mass spectrometer, and methods of operating that apparatus, which result in improved performance at a lower cost when compared with prior spectrometers.

In a time-of-flight mass spectrometer, a bunch of ions enter a field-free drift region with the same kinetic energy and the ions temporally separate according to their mass-to-charge ratios because they travel with different velocities. Ions having different mass-to-charge ratios therefore arrive at a detector disposed at the distal end of the drift region at different times, and their mass-to-charge ratios are determined by measurement of their transit time through the drift region.

Prior detectors for time-of-flight mass spectrometers comprise an ion-electron converter followed by an electron multiplying device. In some embodiments, ions strike a surface of the multiplying device to release electrons and a separate converter is not provided. Because the detector must respond to ions leaving the whole exit aperture of the drift region, it is conventional to use one or more micro-channel plate electron multipliers as the multiplying device. A collector electrode is disposed to receive the electrons produced by the channelplates and means are provided to respond to the current flow so generated and produce an output signal. The chief difference between such a detector and the similar device conventionally used with magnetic sector, quadruple or quadrupole ion-trap spectrometers is the electronic signal processing, which must produce signals indicative of the transit time of the ions as well as the number arriving in any particular time window (corresponding to one or more mass-to-charge ratios). This data must be generated and read out before the next bunch of ions can be admitted into the drift region, so that detector speed is an important determinant of the repetition rate, and hence the sensitivity, of the entire spectrometer.

The earliest detectors for time-of-flight spectrometers comprised a DC amplifier connected to the collector electrode and an analogue-to-digital converter (ADC) for digitizing the output of the amplifier. Usually, this arrangement was used with time-slice detection whereby the amplifier was gated to respond only to ions arriving within a certain time window (typically corresponding to one mass unit). The time window was moved (relative to the time of entrance of ions into the drift region) during repeated cycles of operation so that a complete mass spectrum was eventually recorded. An improvement involved the use of several amplifiers and ADC's arranged to simultaneously record a different time window. Nevertheless, many cycles of the spectrometer are still required to record a complete mass spectrum and the repetition rate of the spectrometer is severely limited by the time taken for the analogue-digital conversion in each cycle. Digital transient recorders (for example, as described in U.S. Pat. Nos. 4,490,806, 5,428, 357 and PCT applications W094/28631 and W095/00236) have been devised to efficiently process the digital data produced by the ADC, but, particularly in the case of time-of-flight mass analyzers for the analysis of organic compounds, these do not represent a cost-effective solution to the problem of achieving a high repetition rate.

An alternative detection system for time-of-flight mass spectrometers is based on ion counting. In these methods, a signal due to a single ion impact on the detector is converted to a digital boolean value, "true" (which may be represented by a digital, "1") in the case of an ion impact, or "false" (e.g, a digital "0") if there has been no ion impact. Various types of timers and/or counters are then employed to process the digital data produced. For example, a counter associated with a particular time window may be incremented whenever a signal is generated in that time window. Alternatively, the output of a timer, started when an ion bunch enters, may be stored in a memory array whenever the detector generates a "true" signal. The advantage of an ion-counting detector over an analogue detector is that variations in the output signal of the electron multiplier due to a single ion impact, which may be ±50% or more, are effectively eliminated because each signal above the noise threshold is treated identically. Further, an ion counting detector does not suffer from the additional noise inevitably produced by the ADC incorporated in an analogue detector system, and is also taster in operation. Consequently, the contribution of noise to the overall ion count is reduced and a more accurate ion count is achieved, particularly in the case of small numbers of ions. The disadvantage is that the digital signal representing an ion impact must be processed very quickly, before the next ion arrives at the detector, it that ion is to be detected. In practice, all detectors have a "deadtime" immediately following an ion impact, during which they cannot respond to an ion impact. This limits the number of ions which can be detected in a given time, so that a dynamic range of the detector is also limited. Corrections can be made to the detector output to compensate for the effects of deadtime (see, for example, Stephen, Zehnpfenning and Benninghoven, J. Vac. Sci. Technol. A, 1994 vol 12 (2) pp 405–410), and in co-pending European patent application claiming priority from GB 9801565.4 filed Jan. 23, 1998, but even when such corrections are carried out, the detector dynamic range still effectively reduces the performance of a time-of-flight mass spectrometer with such a detector.

An improved ion-counting detector for time-of-flight mass spectrometry has been described in general terms by Rockwood at the 1997 Pittsburgh Conference, Atlanta, Ga. (paper No 733), and is available commercially from Sensar Larsen-Davis as the "Simulpulse" detector. According to information published by Sensar Larson-Davis it comprises a large number of individual equal-area anodes, each of which is provided with a digital pulse generating circuit which is triggered by the arrival of an ion at its associated anode. The anodes are disposed in a wide-area detector so that they are all equally likely to be struck by an ion exiting from the drift region. Consequently, simultaneous (or near-simultaneous) ion strikes are most likely to occur on different electrodes and the effect of detector deadtime is greatly reduced. The data from each of the anodes is summed into an 8-bit digital word representative of the ion intensity at any particular time, and the value of that word and its associated time is stored in a digital memory. However, such a detector is obviously complicated and expensive to manufacture.

An electron multiplier ion detector for a scanning mass spectrometer which has two modes of operation to extend its dynamic range is disclosed by Kristo and Enke in Rev. Sci. Instrum. 1988 vol 59 (3) pp 438–442. This detector comprises two channel type electron multipliers in series together with an intermediate anode. The intermediate anode was arranged to intercept approximately 90% of the electrons leaving the first multiplier and to allow the remainder to enter the second multiplier. An analogue amplifier was connected to the intermediate anode, and a discriminator and pulse counter were connected to an electrode disposed to receive electrons leaving the second multiplier. The outputs of the analogue amplifier and pulse counter were electronically combined. A protection grid was also disposed between the multipliers. At high incident ion fluxes, the output signal comprised the output of the analogue amplifier connected to the intermediate anode. Under these conditions a potential was applied to the protection grid to prevent electrons entering the second multiplier (which might of otherwise cause damage to the second multiplier). At low ion fluxes, the potential on the protecting grid was turned off and the output signal comprised the output of the pulse counter. In this mode the detector operated in the single ion counting mode. In this way the detector was operable in a low sensitivity analogue mode using the intermediate anode and a high sensitivity ion counting mode using both multipliers and the pulse counter, so that the dynamic range was considerably greater than a conventional detector which only uses one of these modes.

Other prior art teaching of electron multipliers with means for extending the dynamic range includes a simultaneous mode (i.e., pulse counting and analogue) electron multiplier taught in U.S. Pat. No. 5,463,219. U.S. Pat. No. 4,691,160 teaches a discrete dynode electron multiplier having two final collector electrodes of different areas, each connected to a separate analogue amplifier and selectable by means of a manually operated switch. Soviet Inventors Certificate SU 851549 teaches the disposition of a control grid between two channelplate electron multipliers, the potential on which can be adjusted to control the gain of the assembly. GB patent application 2300513 teaches a similar control grid disposed between certain dynode sheets in an electron multiplier comprising a stack of such sheets, and which is especially suitable for a photomultiplier tube. Prior art disclosed in U.S. Pat. No. 4,691,160 also comprises a continuous dynode electron multiplier having two collector electrodes, one of which is capable of receiving electrons from a dynode disposed prior to the final dynode so that the multiplier has less gain.

Multiple anode detectors have also been used in time-of-flight mass spectrometers for imaging the spatial distribution of ions leaving the drift region, usually in conjunction with imaging time-of-flight analyzers. Such position-sensitive detectors are taught by Cierjacks, Petkovic et al. in Nucl. Instrum. and Methods in Phys. Res., 1985 vol A238 pp 354–364, Kellogg in Rev. Sci. Intrum. 1987 vol 58 (1) pp 38–42 and in PCT application No. WO87/00682. These detectors produce signals indicative of the spatial co-ordinates of an ion impact and operate in a substantially different way from the multiple-anode "Simulpulse" detector. They are generally slow in operation and use analogue signal processing rather than the ion-counting principle employed in the present invention.

SUMMARY OF THE INVENTION

It is an object of the present invention to provide a time-of-flight mass spectrometer and a detector therefor, which has a greater dynamic range than most prior apparatus and which is cheaper to manufacture than prior spectrometers and detectors of equivalent performance. It is a further object to provide methods for operating such a spectrometer and detector.

According to a first aspect of the present invention there is provided a time-of-flight mass spectrometer.

The term, "effective area" should be taken to mean the area of that part of a collection electrode on which the ions or other particles may impinge, corrected as necessary for any lack of uniformity in the spatial distribution of ions incident on said ion detection means.

Preferably, the ion detection means further comprises charged-particle multiplying means which receives the ions leaving the drift region and produces a burst of electrons in response to each ion arriving at the detection means. In such a case, the collection electrodes are disposed to receive these electrons.

Typically, one or more channelplate electron multipliers may be used.

A separate conversion electrode, disposed to receive ions leaving the drift region and to generate secondary particles which then enter a particle multiplying means, may also be provided.

The collection electrodes may conveniently comprise two or more plate-like electrodes of different effective areas disposed in the same plane.

Alternatively, they may comprise one or more partially transparent electrodes disposed in front of one or more plate-like electrodes so that the partially transparent electrode(s) intercept a proportion of the incident ion/electron flux and transmit the remainder to the plate-like electrodes behind them.

A suitable partially transparent electrode may comprise a grid electrode, in which the case the ratio of the effective areas of the grid electrode and a plate-like electrode will be determined by the transmission efficiency of the grid.

More preferably, however, the partially transparent electrodes may comprise a single wire. It has been found in practice that the effective area of a thin single-wire electrode disposed between a plate-like electrode and the electron multiplier plates is considerably greater than its actual area.

In preferred embodiments, said means for determining the number of ions having one or more selected transit times comprises means for counting the number of ion arrivals which have been registered at:

(a) The largest of said electrodes for which the arrival rate at that selected transit time does not exceed a predetermined value above which the presence of said dead-time would result in significant errors in the numbers of ion arrivals registered at that electrode, and (b) At least one electrode smaller than that defined in (a) above, if present.

In preferred embodiments, the means for registering the arrival of an ion may comprise a fast discriminator which generates a digital, "true" signal whenever the voltage on its associated collector electrode rises above a pre-selected threshold level in response to the arrival of charged particles on the electrode.

Means for determining the transit time of ions through the drift region may comprise a multi-stop time digitizer which is started when a bunch of ions enters the drift region and which generates a digital elapsed time signal in response to the generation of a "true" signal from the discriminators associated with the collection electrodes.

The elapsed time signals may then be stored in a digital memory together with a flag indicative of which collector electrode each signal is associated with.

In further preferred embodiments, two collector electrodes are provided, the larger one having an effective area between 2 and 20 times, and most preferably about 8 times, that of the smaller.

Means for counting the ion arrivals registered at each of said selected transit times may comprise a suitably programmed digital computer. Conveniently, clock pulses corresponding to each of the selected transit times are generated and at each clock pulse each means for registering an ion arrival is interrogated. In the case that an ion arrival is registered during a given clock pulse, the digital representation of the transit time from the time digitizer is stored in memory, together with a flag indicative of which electrode the arrival was at. The time digitizer may be reset on the generation of a new ion bunch so that the arrivals of ions in different bunches with a given mass-to-charge ratio are recorded with equivalent transit times. Alternatively, the time at which each ion bunch is generated may be stored along with the ion arrival times so that actual transit times can be calculated later by subtraction of the start time of the ion bunch with which each arrival time is associated. At the end of a series of ion bunches, the total number of ions arriving at each of the collection electrodes at one or more (typically all) selected transit times may then be computed.

Digital computing means may also be used to estimate the ion arrival rate at each collection electrode and to establish whether or not it exceeds a predetermined value.

Unfortunately, a decision on whether data from the second collection electrode is reliable at any given transit time cannot be made directly on the basis of the observed ion arrival rate at that electrode because the observed rate may be affected by deadtime. For example, the observed rate may fall to zero in the case of an extending deadtime detector subject to a high ion arrival rate.

A preferred method of estimating the ion arrival rate at an electrode is to count the number of ion arrivals at the smallest electrode at each of said selected transit times. If these are less than a predetermined value, then the ion arrival rate at the largest electrode at that transit time may be regarded as being sufficiently low to avoid deadtime problems. Consequently, data from the larger electrode may be used to determine the number of ions having that selected transit time. However, if the number of ion arrivals at the smaller electrode exceeds the predetermined value, data associated with the larger electrode is likely to be inaccurate and the number of ions having that transit time should be determined from the data associated with the smaller electrode only. The predetermined value may be established by determining the ratio of the ion counts at both electrodes at different incident ion fluxes. This ratio will remain constant as the flux is increased up to the point at which deadtime effects begin to affect the data associated with the larger electrode. At that point, the ratio will become biased in favour of the smaller electrode and the predetermined value may be established accordingly.

Alternatively, in a less preferred embodiment, the ion arrival rate may be estimated by implication from the ratio of the number of bunches in which an ion arrival is registered at a given transit time to the total number of ion bunches. Should this ratio exceed a predetermined value (established from a consideration of the known detector deadtime relative to the frequency of the generation of the ion bunches), data associated with the largest electrode may be rejected and use should be made only of data associated with the next smaller electrode. The ion arrival rate at the smaller electrode will obviously be less than that at the larger electrode (in proportion to the ratio of the effective areas of the electrodes), so that the loss of counts due to ions arriving during its deadtime will be correspondingly smaller. Count data associated with the smaller electrode is then typically employed in preference to that associated with the larger electrode for subsequent transit times until the ion arrival rate at the larger electrode has fallen to an acceptable level. Care must be taken in the case of detectors having extending deadtimes that the lack of ion counts due to complete saturation of the larger electrode is not mistaken for a reduction in the true ion arrival rate, typically by inspection of the count data of the smaller electrodes, which in these circumstances will indicate ion arrivals while none are being registered at the larger electrode.

Alternatively, data associated with the second collection electrode may be corrected step-by-step for the effects of deadtime, starting at the beginning of a peak. The magnitude of the correction so generated may then indicate that the ion arrival rate at the electrode later in the peak would be so great that adequate correction would be impossible, in which case data from the first collection electrode alone should be used to characterise the entire peak.

This method has the advantage that more accurate counts can be obtained for an ion arrival rate which is not so high as to require a switch to data associated with a smaller electrode but is high enough to result in some losses due to deadtime.

A further preferred embodiment comprises use of the method of deadtime correction taught in co-pending PCT patent application No. PCT/GB99/00251 filed Jan. 25, 1999 which requires that the raw count data from the largest electrode is first processed by conventional mass spectrometric data handling software to produce an uncorrected mass spectrum which is subsequently corrected for the effects of deadtime by means of a previously calculated look-up table.

In the method of that application, the data acquired is processed to produce at least one observed mass spectrum comprising data representing the number of ions having particular transit times, and to recognize in the mass spectrum portions of the data which correspond to mass peaks. The process determines from at least one of said portions of data an observed peak area and an observed mass centroid; uses a predetermined peak shape function characteristic of said time-of-flight mass spectrometer and selected according to said observed mass centroid, to determine from said observed mass centroid a distribution function indicative of the shape of said mass peak; and applies a correction to said observed mass centroid to obtain a value of said mass centroid corrected for the effect of detector dead-time, said correction being obtained from a predetermined correction table which gives values of said correction for different values of said distribution function and said observed peak areas, said predetermined table having been obtained by predicting the effect of said detector dead-time on each of a plurality of simulated mass peaks having said peak-shape functions for appropriate ranges of said distribution functions and peak areas.

The digital computing means is further programmed to multiply the data associated with the smaller electrode by a factor based on the ratio of the effective areas of the electrodes to make the data associated with that electrode comparable with that associated with the larger electrode.

The invention extends the dynamic range of the spectrometer because in prior single-collector electrode spectrometers, the ion flux has to be limited to prevent saturation of the detector, otherwise data is irretrievably lost, even if prior methods of deadtime correction are applied. In a spectrometer according to the invention, the ion-flux can be increased beyond that which would cause saturation of the largest collector, thereby allowing low intensity peaks to be recorded using data associated with the largest electrode, while the most intense peaks may be recorded using data associated with the smaller electrodes. A similar result is achieved by the prior "Simulpulse" detector discussed above, but the present invention, using electrodes of different effective areas represents a more cost-effective solution by reducing the number of electrodes and their associated electronics. In the invention, the dynamic range may be increased by approximately a factor of 10 by the use of two electrodes having a ratio of areas of 10:1 while a similar increase using the prior detector would require 10 electrodes of equal areas.

It will be appreciated that the invention is particularly valuable when the spectrometer comprises an ion source which is capable of producing intense ion beams at certain masses and far smaller ion beams at other masses, for example an inductively-coupled plasma ion source or electron-impact, chemical ionization or APCI ion sources. However, other types of ion sources, for example electrospray or matrix-assisted laser desorption ion sources (MALDI) may also be employed.

According to a second aspect of the present invention there is provided a method of time-of-flight mass spectrometry.

Preferred variations on the method will be apparent from the discussion presented above in respect of the apparatus of the invention.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
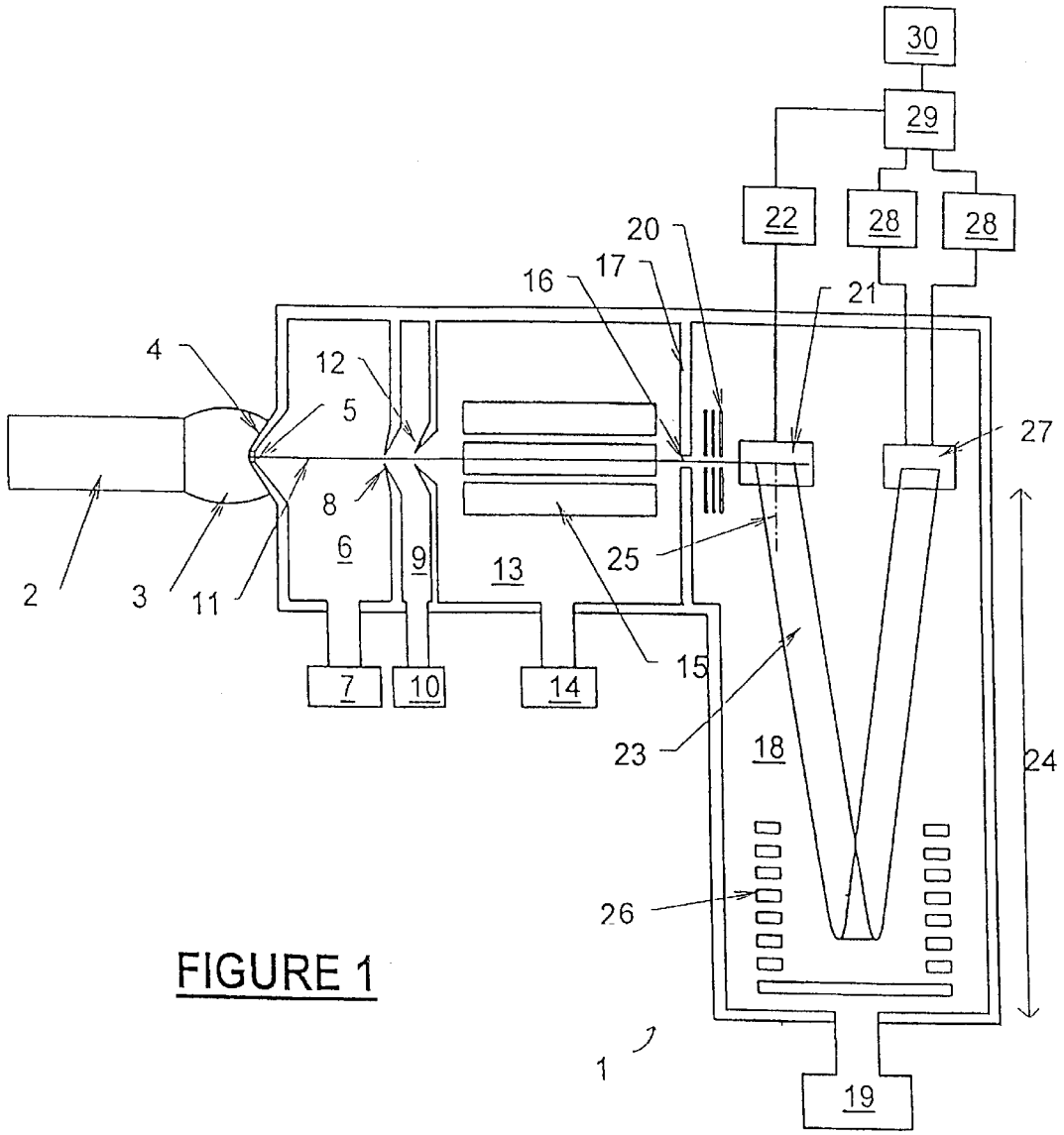
FIG. 1 is a schematic drawing of an ICP mass spectrometer.

Referring first to FIG. 1, an ICP mass spectrometer generally indicated by 1 comprises an ICP torch 2 which generates a plasma 3. As in conventional ICP mass spectrometers a sample to be analyzed may be introduced into the torch 2 entrained in the torch gas supplies (not shown). Ions characteristic of such a sample are generated in the plasma 3. The torch 2 is disposed adjacent to a sampling cone 4 which comprises an orifice 5 through which at least some of the ions generated in the plasma 3 may enter a first evacuated chamber 6 which is pumped by a first pump 7. In agreement with conventional practice there is provided a skimmer 8 which cooperates with the sampling cone 4 to provide a nozzle-skimmer interface. An additional stage of pumping is provided by a second pump 10 connected to a second evacuated chamber 9. Ions from the plasma 3 exit from the skimmer 8 along an axis 11, pass through the second evacuated chamber 9 and exit through a third evacuated chamber 13 through an orifice in a conical extraction lens 12 which forms part of the boundary wall between the chambers 9 and 13. The third chamber 13 is evacuated by a third pump 14. In accordance with the teachings of EP patent application 0813228 a hexapole rod assembly 15 (containing gas at a pressure of about $10^{-2}$ torr) is provided in the third evacuated chamber 13 to reduce interferences from unwanted species and reduce the energy spread of ions.

After passing through the rod assembly 15 ions pass through an orifice 16 in a wall 17 which divides the third evacuated chamber 13 from a fourth evacuated chamber 18 which contains a time-of-flight mass analyzer. A vacuum pump 19 maintains the pressure in the chamber 18 at $10^{-6}$ torr or better. On entering the evacuated chamber 18 the ions pass through an electrostatic focusing lens 20 and enter an ion pusher 21, electrodes in which are fed with pulses from a pulse generator 22 in such a way that bunches of ions are repeatedly ejected parallel to an axis 25 into a drift region 24. In a general sense, therefore, items 1–24 comprise an ion source for repeatedly generating bunches of ions. The ion pusher 21 comprises ion accelerating means for causing at least some of these bunches to enter the drift region with substantially the same component of kinetic energy along the axis 25 (which is perpendicular to the ion axis 11). This arrangement therefore comprises an orthogonal acceleration time-of-flight analyzer, but a linear arrangement is also within the scope of the invention. The ions leaving the ion pusher 21 travel into the drift region 24 along a trajectory 23, (which deviates from the axis 25 because the ions have a finite component of velocity in the direction of the ion axis 11), and become separated in time according to their mass to charge ratios. The drift region 24 is a reflecting type analyzer and comprises an electrostatic ion mirror 26 which changes the direction of travel of the ions following trajectory 23 and directs them into an ion detector 27. Use of the ion mirror 26 both decreases the size of the spectrometer and improves mass resolution but a linear analyzer could be used if desired. Means for registering the arrival of a said ion comprises at least two fast discriminators 28 (one for each of the electrodes in the ion detector 27) and produces a digital signal each time an ion arrives at the detector 27. Means for determining the transit time of ions through the drift region 24, and means for determining the number of ions having one or more selected travel times comprise a clock generator 29 and a digital computer 30 and are described in more detail below.

Figure 2:
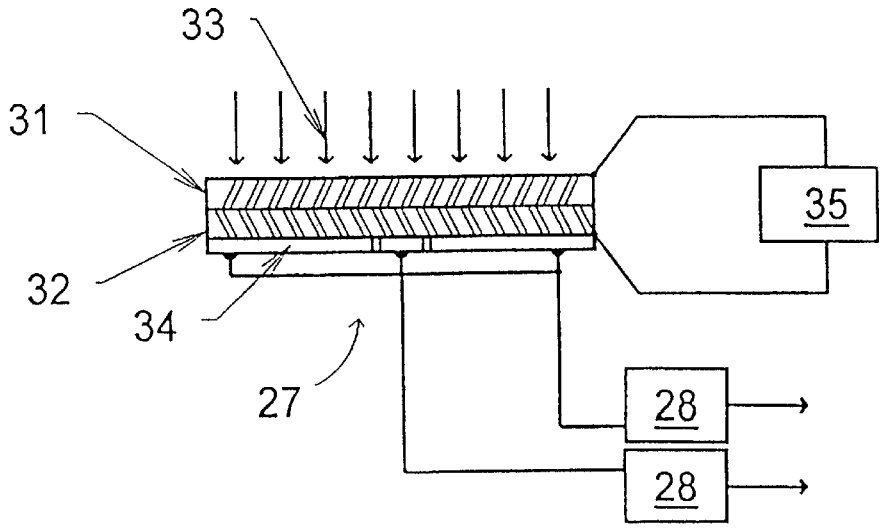
FIG. 2 is a drawing of an ion detector.

Referring next to FIG. 2, an embodiment of the ion detector 27 suitable for use in the invention comprises first and second microchannel multiplier plates 31 and 32 disposed to receive ions directed towards the detector 27 by the ion mirror 26 (FIG. 1). This ion flux is schematically illustrated in FIG. 2 by the arrows 33. Each ion strikes the front surface of the first multiplier plate 31 causing the release of a burst of electrons at its rear surface at a point corresponding to the ion impact. These electrons are received at the front face of the second multiplier plate 32 so that a larger burst of electrons is generated at its rear face. These impact on a collection electrode array 34 and the charge so transferred to one or more of the electrodes in the array is detected by the discriminators 28. A power supply 35 maintains potential differences between the faces of the multiplier plates 31 and 32, as required for their proper operation.

Figure 3:
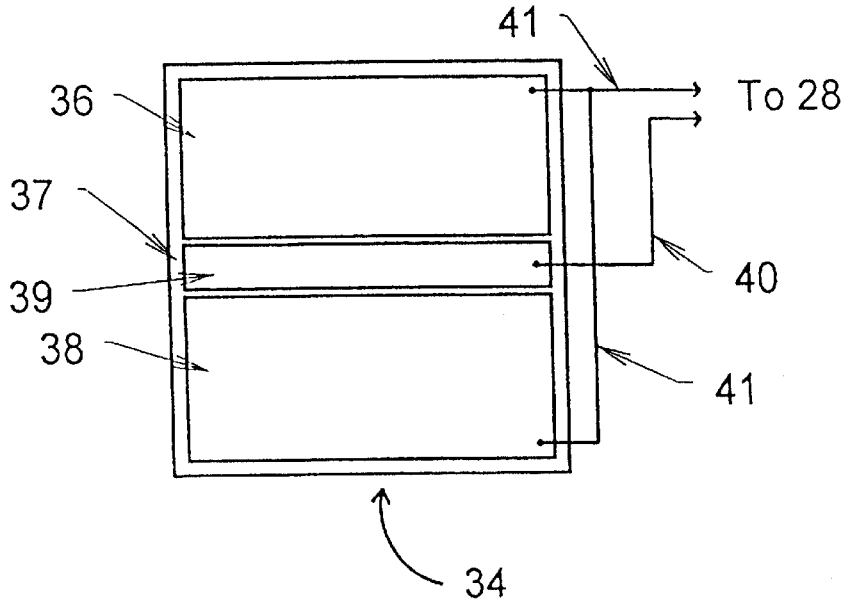
FIG. 3 is a drawing of a collector electrode array suitable for use in the detector of FIG. 2.

A collection electrode array suitable for use in the invention is illustrated in FIG. 3. It comprises an insulated substrate 37, typically of ceramic, on which are coated three electrically conductive electrodes 38, 39 and 36. Two of these, electrodes 38 and 36, are connected by the lead 41 and function as a single electrode of area approximately eight times that of the smaller electrode 39. This arrangement of electrodes compensates for an inhomogeneous distribution of the ion flux represented by the array 33, at least along an axis parallel to the long dimension of the electrode 39, but of her arrangements of electrodes are within the scope of the invention.

It will be appreciated that the arrival of the ions at the detector 27 is random in space (in the absence of any instrumentally introduced inhomogeneity) so that the number of ion arrivals recorded at the composite larger electrode comprising electrodes 38 and 36 will be according to the preferred embodiment approximately eight times that recorded on the smaller electrode 39. In this invention the detector is not position sensitive and, given a homogeneous ion flux, the only significance of the pattern of the electrodes is the ratio of their areas. It, however, in any practical embodiment the ion flux is known to be inhomogeneous, the electrode pattern can be arranged to minimize its effect.

Figure 4:
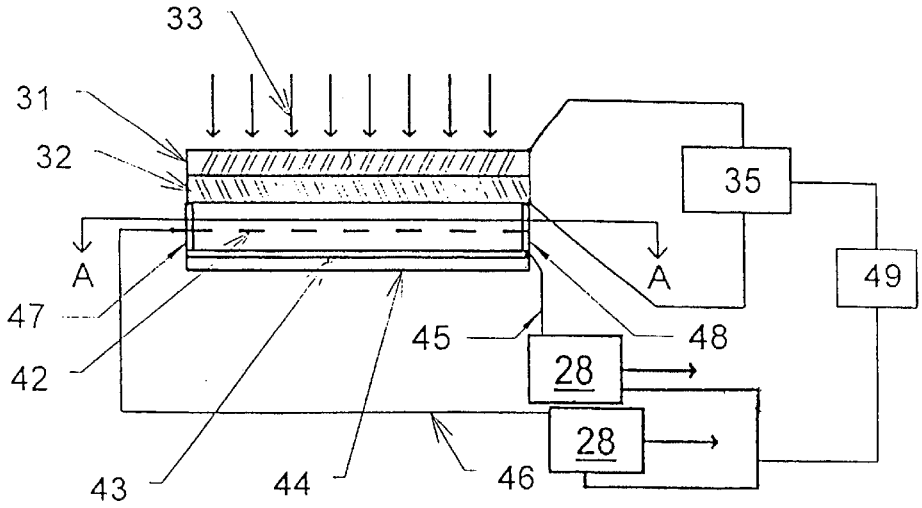
FIG. 4 is a drawing of an alternative ion detector.

An alternative ion detector is illustrated in FIG. 4. It comprises an insulated substrate 44 on which is coated a plate-like electrode 43. Electrode 43 is connected by a lead 45 to one of the discriminators 28. A grid electrode 42 is supported by insulators 47 and 48 between the exit face of the multiplier plate 32 and the plate-like electrode 43. The grid electrode 43 has a transparency such that it intercepts approximately 12.5% of the electrons leaving the multiplier plate 32 and transmits the remainder to the plate-like electrode 43. A lead 46 connects the grid electrode 42 to another of the discriminators 28.

Figure 5:
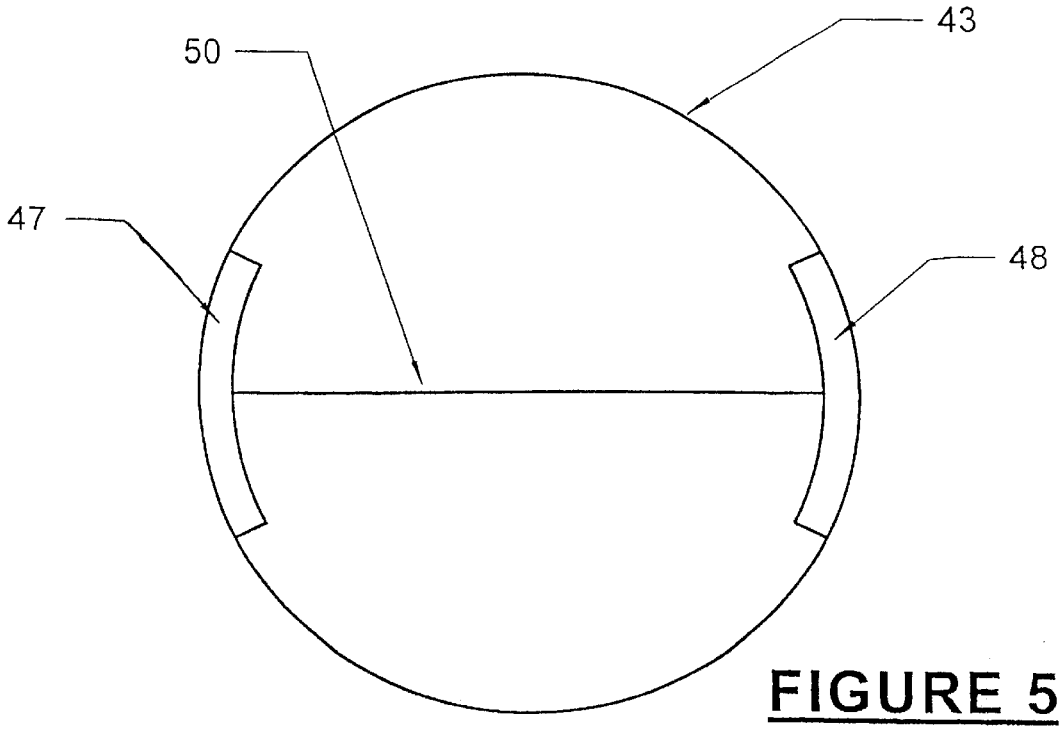
FIG. 5 is a sectional view in the plane AA shown in FIG. 4.

A disadvantage of the ion detector shown in FIG. 4 is that the effective area of the grid electrode is strongly dependent on the threshold setting of the discriminator 28. For the grid electrode the amplitude of the current pulses produced extends over a greater range than those produced by the plate-like electrode 43, presumably because electrons passing close to the wires comprising the grid but not actually striking a wire induce a signal in the electrode which is smaller than the minimum signal which would be produced by impact of those electrons on a solid electrode. This effect becomes more pronounced as the number of wires comprised in the grid is increased. While it has the effect of allowing the effective area of the grid to be varied by adjusting the threshold of the discriminator 28, it is more difficult to maintain the ratio of the effective areas of the grid electrode 42 and the plate electrode 43 at a constant value. Consequently, in a more preferred embodiment of the ion detector the grid electrode 42 (FIG. 4) may be replaced by a single wire 50 stretched across the electrode 43 between the insulators 47 and 48. FIG. 5 is a sectional view in the direction of the ion flux 33 in the plane AA shown in FIG. 4 and shows such an arrangement. Typically a wire 0.5 mm diameter can be used. The range of pulse amplitudes produced by such an electrode is smaller than that produced by a grid electrode but still greater than that produced by the plate electrode, which provides adequate stability of the ratio of the effective areas while allowing some adjustment of that ratio by alteration of the threshold level of the discriminator 28. Because of this "induction" effect the effective area of the wire 50 is considerably greater than its actual area.

A power supply 49 is arranged to bias positively the inputs of the discriminators 28 relative to the exit face of the multiplier plate 32 so that electrons leaving it are accelerated towards the grid electrode 42 and the plate-like electrode 43. In this embodiment the larger electrode comprises the plate-like electrode 43 which has an effective area approximately 8 times that of the smaller electrode which comprises the grid electrode 42. However, a more accurate value of the ratio of the effective areas can be established by monitoring the signals from both electrodes simultaneously.

As explained above, although two electrodes are adequate for most purposes, it is also within the scope of the invention to use a greater number, each of which has a different area. Further, particularly in the event of inhomogeneity of the incident ion beam, the effective areas of the electrodes may not be exactly equivalent to their actual areas. The ratio of the effective areas may be easily established, however, by monitoring the signals from both electrodes while the detector is receiving a substantially constant ion flux, for example from a calibration compound introduced into the ion source. Care must be taken, however, that the ion intensity during the calibration process is not so great that the signal from the larger electrode is distorted by detector dead-time.

Each electrode comprised in the array is connected to a fast discriminator 28 which responds to the arrival of charge at an electrode by generating a digital signal comprising a flag and a time value obtained from a clock pulse generator 29 at the moment the arrival of charge is detected. A digital computer 30 stores this value so that the transit time of the ion which generated the signal can be determined. To facilitate this, the time at which the ion pusher 21 is activated by the pulse generator, thereby causing a bunch of ions to enter the drift region, is also stored by the computer 30. The transit time of each detected ion is determined merely by subtracting the appropriate time of entry of the ions into the drift region from the time at which the ion is detected, using a digital computer 30.

The computer 30 is programmed to determine the number of ions having one or more transit times as follows:

First, the number of times an ion arrival is registered at each of the electrodes at each tick of the clock pulse generator 29, is determined by inspection of the flagged transit time data, so that a histogram of ion counts against transit time (which corresponds to a mass spectrum uncorrected for dead-time) may be produced in respect of each electrode. In the event that only certain mass peaks need to be monitored, ion count data need only be retained at each of one or more selected transit times (i.e., clock ticks) corresponding to the mass-to-charge ratios to be monitored.

Next, the ion arrival rate at the smallest collection electrode 39 is compared with a predetermined value (typically established by experiment, as explained previously) to establish whether or not data from the composite largest electrode (38,36) is acceptable. If it is, the sum of the counts on both the largest electrode and the smallest electrode is used to determine the number of ions having that particular transit time. If the comparison indicates that data associated with the larger electrode is likely to be inaccurate, only data associated with the smaller electrode 39 is used, multiplied by a factor dependent on the ratio of the effective areas of the electrodes. This process is repeated for each of the selected transit times.

An alternative method of estimating the ion arrival rate is the application of a prior method of deadtime corrections to the raw count data at each selected transit time, such as that discussed by Stephan (see above). The point at which the ion arrival rate becomes high enough for the significant dead-time corrections to be necessary will then be obvious from the results of the correction process. If corrections are applied to the count data then a higher predetermined value for the ion arrival rate can be used to trigger the switch to a smaller electrode because the corrections applied will result in more reliable data being produced for the larger electrodes at high arrival rates. However, use of most prior methods of deadtime correction incurs significant computing time, thereby reducing the repetition rate of the spectrometer, or requires storage of a large volume of data in high-speed memory. Another method of applying some deadtime correction is to process the uncorrected count data using conventional mass-spectrometric data processing software to recognise the mass peaks and produce a "stick" mass spectrum comprising values of ion intensity for each recognised mass peak using data obtained on one or more electrodes including the largest one. This data may then be corrected for deadtime according to the method of a co-pending International Application No. PCT/GB99/00251 filed Jan. 25, 1999. This will indicate regions of the spectrum where the ion arrival rate is high enough to require only the use of data associated with the smaller electrode, and those portions of the spectrum may then be replaced by equivalent portions obtained by an identical treatment of the ion count data obtained on the smaller electrode, allowing for the ratio of the effective areas of the electrodes.

What is claimed is:

1. A time-of-flight mass spectrometer (1) comprising:

an ion source (1–24) for repetitively generating bunches of ions from a sample being analyzed;

ion accelerating means (21) for causing at least some of the ions comprised in each of said bunches to entering a drift region (24) along an axis (25) with substantially the same component of kinetic energy along said axis (25), in which drift region (24) they become separated in time according to their mass-to-charge ratios;

ion detection means (27) disposed to receive ions after they have passed through said drift region (24);

means (29,30) for determining the transit time of said ions through said drift region (24); and means (29,30) for determining the number of ions having one or more selected transit times;

characterized in that:

said ion detection means (27) comprises:

at least two collection electrodes (36,38;39), each of which has a different effective area, and on which said ions or particles generated from said ions may impinge, each said collection electrode (36,38;39) having associated therewith separate means (28) for registering the arrival of a said ion, each said collection electrode (36,38;39) and its associated means (28) for registering having a deadtime consequent upon an earlier ion arrival during which it cannot register another ion arrival; and said means (29,30) for determining the number of ions having one or more selected transit times comprises:

counting means (29,30) for counting the number of ion arrivals which have been registered at a said selected transit time at one or more electrodes including the largest of said collection electrodes (36,38;39) for which the ion arrival rate at that selected transit time does not exceed a predetermined value above which the presence of said deadtime would result in significant errors in the number of ion arrivals registered at that electrode.

2. A time-of-flight mass spectrometer as claimed in claim 1, wherein said ion detection means (27) further comprises at least one charged-particle multiplying means (31,32) for receiving ions leaving the drift region (24) and for producing a burst of electrons in response to each ion arriving at said ion detection means (27) and wherein said collection electrodes (36,38;39) are arranged to receive electrons comprised in said bursts.

3. A time-of-flight mass spectrometer as claimed in claim 2, wherein said at least one charged-particle multiplying means (31,32) comprises a channelplate electron multiplier (31,32).

4. A time-of-flight mass spectrometer as claimed in claim 2, further comprising a separate conversion electrode, disposed to receive ions leaving said drift region (24) and to generate secondary particles for impinging upon said charged-particle multiplying means (31,32).

5. A time-of-flight mass spectrometer as claimed in claim 1, wherein said at least two collection electrodes (36,38;39) comprise two or more plate-like electrodes.

6. A time-of-flight mass spectrometer as claimed in claim 5, wherein said two or more plate-like electrodes are disposed in the same plane.

7. A time-of-flight mass spectrometer as claimed in claim 5, wherein said collection electrodes comprise two collection electrodes (36,38;39), the larger of said collection electrode (36,38) having an effective area between 2 and 20 times, that of the smaller collection electrode (39).

8. A time-of-flight mass spectrometer as claimed in claim 1, wherein said collection electrodes comprise at least one partially transparent electrode (42;50) disposed in front of at least one plate-like electrode (43), wherein said at least one partially transparent electrode (42;50) intercepts in use a proportion of the incident ion/electron flux and transmits the remainder to said at least one plate-like electrode (43).

9. A time-of-flight mass spectrometer as claimed in claim 8, wherein said at least one partially transparent electrode comprises at least one grid electrode (42).

10. A time-of-flight mass spectrometer as claimed in claim 8, wherein said at least one partially transparent electrode comprises at least one wire electrode (50).

11. A time-of-flight mass spectrometer as claimed in claim 1, wherein said counting means (29,30) counts in use the number of ion arrivals which have been registered at a said selected transit time at:

(a) the largest of said electrodes for which the arrival rate at that selected transit time does not exceed a predetermined value above which the presence of said deadtime would result in significant errors in the numbers of ion arrivals registered at that electrode; and (b) at least one electrode smaller than that defined in (a) above, if present.

12. A time-of-flight mass spectrometer as claimed in claim 1, wherein the means (28) for registering the arrival of an ion comprises a fast discriminator (28) which generates a digital signal whenever the voltage on its associated collection electrode (36,38;39) rises above a pre-selected level in response to the arrival of charged particles on the collection electrode (36,38;39).

13. A time-of-flight mass spectrometer as claimed in claim 12, wherein said means for determining the transit time of ions through the drift region (24) comprises a multi-stop time digitizer which is started when a bunch of ions enter the drift region (24) and which generates a digital elapsed time signal in response to the generation of a digital signal from said discriminators (28) associated with the collection electrodes (36,38;39).

14. A time-of-flight mass spectrometer as claimed in claim 13, wherein the digital elapsed time signals are stored in a digital memory together with a flag indicative of which collection electrode (36,38;39) each signal is associated with.

15. A time-of-flight mass spectrometer as claimed in claim 1, wherein said counting means (29,30) determines the largest electrode for which the ion arrival rate at said selected transit time does not exceed a predetermined value above which the presence of said deadtime would result in significant errors in the number of ion arrivals registered at that electrode, by predicting the ion-arrival rate at the electrodes from a measurement of the ion-arrival rate at a smaller electrode, and selecting the largest of said electrodes for which the ion-arrival rate so predicted does not exceed said predetermined value for that electrode.

16. A time-of-flight mass spectrometer as claimed in claim 1, wherein said counting means (29,30) determines the largest electrode for which the ion arrival rate at said selected transit time does not exceed a predetermined value above which the presence of said deadtime would result in significant errors in the number of ion arrivals registered at that electrode, by calculating the true ion-arrival rate at each electrode using a dead-time correction algorithm and selecting the largest of said electrodes for which the ion-arrival rate so calculated does not exceed said predetermined value for that electrode.

17. A time-of-flight mass spectrometer as claimed in claim 1, wherein said predetermined value is that value beyond which a dead-time correction algorithm indicates that correction cannot be made to a desired degree of accuracy.

18. A time-of-flight mass spectrometer as claimed in claim 1, wherein said predetermined value is determined by previous experiment to be the highest ion-arrival rate at which the ratio of ion counts at that electrode and a smaller electrode remain substantially constant.

19. A time-of-flight mass spectrometer as claimed in claims 1, wherein said predetermined value is determined by previous experiment as being the highest ion-arrival rate at which the ratio of ion counts at that electrode and a smaller electrode remain substantially constant after correction of at least the data associated with the larger electrode using a dead-time correction algorithm.

20. A method of time-of-flight mass spectrometry comprising the steps of:

repetitively generating bunches of ions from a sample being analyzed;

accelerating at least some of the ions comprised in each of said bunches so that they have substantially the same component of kinetic energy along an axis (25) and allowing them to separate in time according to their mass-to-charge ratios during their subsequent passage through a drift region (24) along said axis (25);

detecting at least some of said ions after they have passed through said drift region (24);

determining for each of those ions so detected their transit times through said drift region (24); and determining the number of ions having one or more selected transit times;

said method characterised in that:

the step of detecting at least some of said ions comprises allowing said ions, or particles generated therefrom, impinging on at least two collection electrodes (36,38;39) of different effective areas, each of which having associated therewith separate means (28) for registering the arrival of a said ion, each said collection electrode (36,38;39) and its associated means for registering (28) having a deadtime consequent upon an earlier ion arrival during which it cannot register another ion arrival; and the step of determining the number of ions having one or more selected transit times comprises counting the number of ion arrivals registered at a said selected transit time at one or more electrodes including the largest of said collection electrodes (36,38;39) for which the ion arrival rate at that selected transit time does not exceed a predetermined value-above which the presence of said deadtime would result in a significant error in the number of ions counted.

21. A method of time-of-flight mass spectrometry as claimed in claim 20, further comprising the step of determining the largest electrode for which the ion arrival rate at said selected transit time does not exceed a predetermined value above which the presence of said deadtime would result in significant errors in the number of ion arrivals registered at that electrode, by predicting the ion-arrival rate at the electrodes from a measurement of the ion-arrival rate at a smaller electrode, and selecting the largest of said electrodes for which the ion-arrival rate so predicted does not exceed said predetermined value for that electrode.

22. A method of time-of-flight mass spectrometry as claimed in claim 20, further comprising the step of determining the largest electrode for which the ion arrival rate at said selected transit time does not exceed a predetermined value above which the presence of said deadtime would result in significant errors in the number of ion arrivals registered at that electrode, by calculating the true ion-arrival rate at each electrode using a dead-time correction algorithm and selecting the largest of said electrodes for which the ion-arrival rate so calculated does not exceed said predetermined value for that electrode.

23. A method of time-of-flight mass spectrometry as claimed in claim 20, wherein said predetermined value is that value beyond which said dead-time correction algorithm indicates that correction cannot be made to a desired degree of accuracy.

24. A method of time-of-flight mass spectrometry as claimed in claim 20, wherein said predetermined value is determined by previous experiment to be the highest ion-arrival rate at which the ratio of ion counts at that electrode and a smaller electrode remain substantially constant.

25. A method of time-of-flight mass spectrometry as claimed in claim 20, wherein said predetermined value is determined by previous experiment to be the highest ion-arrival rate at which the ratio of ion counts at that electrode and a smaller electrode remain substantially constant after correction of at least the data associated with the larger electrode using a dead-time correction algorithm.

* * * * *